US009657729B2

(12) United States Patent
Rasch

(10) Patent No.: US 9,657,729 B2
(45) Date of Patent: May 23, 2017

(54) AXIAL PISTON MACHINE HAVING A BASKET

(71) Applicant: DANFOSS POWER SOLUTIONS INC., Ames, IA (US)

(72) Inventor: Harry Rasch, Seedorf (DE)

(73) Assignee: DANFOSS POWER SOLUTIONS INC., Ames, IA (US)

( * ) Notice: Subject to any disclaimer, the term of this patent is extended or adjusted under 35 U.S.C. 154(b) by 381 days.

(21) Appl. No.: 14/284,806

(22) Filed: May 22, 2014

(65) Prior Publication Data

US 2014/0352525 A1 Dec. 4, 2014

(30) Foreign Application Priority Data

May 29, 2013 (DE) ..... 10 2013 210 070

(51) Int. Cl.

| | |
|---|---|
| ***F01B 1/06*** | (2006.01) |
| ***F04B 27/22*** | (2006.01) |
| ***F04B 1/20*** | (2006.01) |
| ***F04B 1/24*** | (2006.01) |
| ***F04B 53/22*** | (2006.01) |
| ***F03C 1/06*** | (2006.01) |

(52) U.S. Cl.

CPC ..... *F04B 27/22* (2013.01); *F03C 1/0642* (2013.01); *F04B 1/2035* (2013.01); *F04B 1/2064* (2013.01); *F04B 1/24* (2013.01); *F04B 53/22* (2013.01)

(58) Field of Classification Search

CPC ..... F04B 27/22; F04B 1/24; F03C 1/0642; F03C 1/0663; F03C 1/0665

USPC ..... 92/12.1

See application file for complete search history.

(56) References Cited

U.S. PATENT DOCUMENTS

| | | | | |
|---|---|---|---|---|
| 5,241,882 A * | 9/1993 | Eriksson | B23D 63/162 33/202 |
| 2010/0172766 A1* | 7/2010 | Lindholdt | F01B 3/0044 417/53 |

FOREIGN PATENT DOCUMENTS

| | | |
|---|---|---|
| DE | 1118010 | 11/1961 |
| DE | 4203619 A1 | 8/1993 |
| DE | 102011009537 A1 | 8/2012 |

* cited by examiner

*Primary Examiner* — Thomas E Lazo
*Assistant Examiner* — Daniel Collins
(74) *Attorney, Agent, or Firm* — Zarley Law Firm, P.L.C.

(57) ABSTRACT

Mounting structure for housing-free hydraulic axial piston machines of the bent axis or swash plate design, having a closing plate on which a cylinder block unit with displacing pistons arranged therein is supported, and having a drive or driven shaft. The mounting structure here is designed in the manner of a basket and has a receptacle for the drive or driven shaft and at least two struts which are in each case connected at one end to the receptacle and at the other end to the closing plate in such a manner that the closing plate, the cylinder block unit and the drive or driven shaft are held—analogously as in a housing—in a functionally ready position.

10 Claims, 6 Drawing Sheets

Schnitt A-A

AXIAL PISTON MACHINE HAVING A BASKET

BACKGROUND OF THE INVENTION

The invention relates to hydraulic axial piston machines, in particular hydraulic axial piston machines of the swash plate or bent axis type of construction, both in the form of a constant unit or a displacement unit in the embodiments thereof as hydraulic pumps or hydraulic motors. The invention relates here, by way of example, to displacement axial piston machines, in which the supply volume can be adjusted by swiveling displacement devices, such as swash plates or bent axes.

Hydraulic axial piston machines have a rotating cylinder block unit which is usually of cylindrical design. In the circumferential direction of the cylinder block unit cylinder bores are provided rotationally symmetrically parallel to the axis of rotation of the cylinder block unit in which bores displacing pistons are arranged axially oriented. The feet of the displacing pistons are usually supported on a pressure plate which, for example in the case of axial piston machines of the swash plate type of construction, is the swash plate. In case of axial piston machines of the bent axis type of construction, the pressure plate can be integrated into the drive or driven shaft of the axial piston machine or else formed integrally therewith. On the axially opposite side of the pressure plate, a closing plate takes over the support of the cylinder block unit in the axial direction, and therefore the displacing pistons can execute a predeterminable stroke per revolution of the cylinder block unit. By means of the stroke of the displacing pistons in the cylinder bores, a delivery volume or displacement volume of a hydraulic fluid flows through the cylinder block unit and sets the latter—in the case of a hydraulic motor—into rotation. If—in the case of a hydraulic pump—the cylinder block unit is driven, the stroke of the displacing pistons in the cylinder bores produces a delivery volume. A drive or driven shaft via which the cylinder block unit is driveable in a rotatory manner is connected to the cylinder block unit for rotation therewith. In the case of a hydraulic motor, the driven shaft is set into a rotational movement via the cylinder block unit, which is acted upon by pressurized fluid.

So that the rotating parts or the pistons, which are acted upon by hydraulic fluid and are moved in a translatory manner, are held or supported between the pressure plate/swash plate and the closing plate in the position corresponding in each case to the operating state, a housing is conventionally provided, said housing taking on this function and, in particular, holding the supporting elements/abutments, i.e., in particular, the pressure plate/swash plate and closing plate—in the relative positions thereof with respect to one another. The housing also ensures that the drive or driven shaft can be mounted rotatably, wherein said drive or driven shaft, supported axially by the housing, is generally accommodated so as to be rotatable via rolling or plain bearings. The housing furthermore ensures that the pressure plate, on which the displacing pistons are supported, is fixed in the relative position thereof with respect to the rotating cylinder block unit. Depending on the type of construction (swash plate or bent axis type of construction), it is possible for the pressure plate to be swiveled relative to the cylinder block unit or for the cylinder block unit to be swiveled relative to the pressure plate. The drive or driven shaft is generally invariable in its the relative position in the housing and is customarily only rotatable about the longitudinal axis thereof and is otherwise generally immovable axially.

Therefore the housing has further the function of absorbing supporting forces which occur in particular during a swiveling or pivoting operation for changing the delivery volume of the axial piston machine. The forces necessary for supporting the moving components are generally all the more higher, the greater the deflection of the displacement device of the axial piston machine is. The housing therefore has to be designed to be correspondingly stable and robust so that said forces can be reliably absorbed. However, a large space requirement and a high weight are customarily also associated with a solid design of the housing.

The housing furthermore protects the rotating and moving machine parts of the axial piston machine from soiling and other environmental influences. The housing frequently also serves as a liquid reservoir, wherein, even in the case of dry-case motors or dry-case pumps, a leakage liquid reservoir is frequently formed in the housing, which requires an additional amount of space.

The housing therefore has a supporting function and also a protective function for the components of the axial piston machine that are necessary for operating the axial piston machine. The housings of axial piston machines are therefore customarily bulky and heavy and cause high costs for the production of axial piston machines. The provision and installation of the axial piston machine in a housing also requires a multiplicity of working steps which additionally cause high costs. As already explained above, for the reliable operation of an axial piston machine, the moving and rotating parts have, however, to be held in certain predetermined positions relative to one another so that the operation of the axial piston machine is ensured.

In a multiplicity of uses, axial piston machines are connected to mechanical gearings in order to drive working machines or so that an axial piston machine itself can be driven in order to produce a hydraulic fluid flow. Since gearings are usually also provided with a housing, onto which the housing of an axial piston machine is flanged, two separate housings which have to be coordinate with each other are generally necessary in the prior art. In particular, the interface between axial piston machine and gearing has to be designed here in such a manner that a safe and reliable interaction of the axial piston machine with the gearing is ensured. The surfaces, centering means and receptacles which are necessary here for the fastening and centering, together with the necessary production tolerances associated therewith, cause high costs for the production of the two housings—that of the gearing and that of the axial piston machine.

DE 10 2011 009537 discloses a hydrostatic machine, in particular an axial piston machine with a housing. The housing has an inner housing part for receiving the force flux, an outer housing part for sealing and damping, and a housing base. The inner housing part is designed as a supporting frame with struts. A driving shaft passes coaxially through the housing base on the drive side and through a swash plate on the output side and is connected to a cylinder drum for rotation therewith. The driving shaft passes at least partially only through the inner housing part and through the housing base and is mounted rotatably in the inner housing part. The inner housing part is provided for absorbing the dynamic forces occurring in the hydrostatic working mode of the axial piston machine, for which purpose said housing part has to be of high strength. Substantially similar designs of axial piston machines can also be gathered from DE 42 03 619 A1 and DE 1 118 010 A, in which a mechanically robustly designed "yoke" is used instead of the inner housing part.

It is therefore object of the invention to provide a device for an axial piston machine, said device replacing a housing for the axial piston machine to the effect that the axial piston machine can be connected as an assembly to a gearing, wherein both the gearing and the axial piston machine are accommodated in one and the same housing. Furthermore, a device is to be provided, making it possible to transport, store and fit axial piston machines without housings in a simple and uncomplicated manner. The assemblies of closing plate, cylinder block unit with displacer pistons arranged therein and drive or driven shaft are to be positioned with respect to one another in such a manner that said assemblies are securely held and arranged preferably in a functionally ready position. It is a further object of the invention to provide a device which fixes the movable parts of an axial piston machine and hold said parts in position in such a manner that a test run of the axial piston machine at low forces or loads is possible.

The object of the invention is achieved by a mounting structure according to Claim 1, wherein specific embodiments are indicated in the dependent claims. By the further independent claims an axial piston machine which is functionally ready for a test run and a hydromechanical functional unit consisting of an axial piston machine and a gearing with just a common housing are provided.

SUMMARY OF THE INVENTION

According to the invention, a mounting structure for adjustable and non-adjustable axial piston machines of bent axis or swash plate type of construction is provided, in which the movable functional units of the axial piston machine, in particular the cylinder block unit with displacing pistons and drive or driven shaft, are connected to a closing plate in such a manner that the axial piston machine is in a functionally ready arrangement in a manner such as though the individual assemblies are fixed relative to one another by a housing.

It is therefore object of the invention to provide a device for an axial piston machine, said device replacing a housing for the axial piston machine to the effect that the axial piston machine can be connected as an assembly to a gearing, wherein both the gearing and the axial piston machine are accommodated in one and the same housing. Furthermore, a device is to be provided, making it possible to transport, store and fit axial piston machines without housings in a simple and uncomplicated manner. The assemblies of closing plate, cylinder block unit with displacing pistons arranged therein and drive or driven shaft are to be positioned with respect to one another in such a manner that said assemblies are securely held and arranged preferably in a functionally ready position. It is a further object of the invention to provide a device which fixes the movable parts of an axial piston machine and hold said parts in position in such a manner that a test run of the axial piston machine at low forces or loads is possible.

The object of the invention is achieved by a mounting structure according to Claim 1, wherein specific embodiments are indicated in the dependent claims. By the further independent claims an axial piston machine functionally ready for a test run and a hydromechanical functional unit consisting of an axial piston machine and a gearing with just a common housing are provided.

According to the invention, a mounting structure for adjustable and non-adjustable axial piston machines of the bent axis or the swash plate type of construction is provided, in which the movable functional units of the axial piston machine, in particular the cylinder block unit with displacing pistons and drive or driven shaft, are connected to a closing plate in such a manner that the axial piston machine is in a functionally ready arrangement in a manner such as though the individual assemblies are fixed relative to one another by a housing.

For this purpose, the mounting structure according to the invention has a basket-like connecting structure and a receptacle which is arranged thereon and with which the drive or driven shaft can be accommodated. The receptacle can also accommodate, and hold in position, one or more plain or rolling bearings which support the drive or driven shaft. The receptacle is held by the connecting structure which has at least one strut or a basket- or net-like structure and which is connected to the closing plate of the axial piston machine. With the mounting structure according to the invention, the components of an axial piston machine are held via the basket-like mounting structure in the same position as though a housing were present.

The mounting structure according to the invention positions the drive shaft with respect to the closing plate in such a manner that the axial piston machine can be inserted without a housing, and preferably without further intermediate steps, directly into a housing, for example, of a gearbox or of an axle. The closing plate hereby is preferably connected to the gearing housing, for example by screwing, clamping, latching, riveting, etc. Such a closing plate can also contain, for example, a displacement unit for adjusting the delivery or displacement volume of a hydraulic machine. This can be, for example, a servopiston which can swivel a setting element of a bent axis axial piston machine—which may also be a yoke in a specific embodiment—or the swash plate of a swashplate axial piston machine—in the position of said machine in order to adjust the delivery or displacement volume of the hydraulic machine, respectively. Feed lines and discharge lines for hydraulic fluid which supply the cylinder block unit with hydraulic fluid or remove the latter therefrom can furthermore be arranged in the closing plate.

If up to now, in the conventional prior art, an axial piston machine has been gone without a housing, the axial piston machine has had to be installed in individual parts in an assembly housing of a functional unit, for example a gearing or an axle housing, which is obviously time- and cost-intensive. With the mounting structure according to the invention, not only can the housing-free axial piston machine be inserted as a compact assembly into a housing, but the plain or rolling bearings provided for the mounting of the drive or driven shaft of the axial piston machine in the gearing housing can already be pre-installed on the drive or driven shaft and inserted simultaneously with the installation of the axial piston machine in the gearing housing. The mounting structure according to the invention preferably has the task here not only of holding together the movable parts of an axial piston machine, but also of positioning said parts as though the axial piston machine were accommodated in a functionally ready manner in a housing. In this case, at least the components—closing plate, cylinder block unit with displacing pistons arranged therein, pressure plate, on which the displacing pistons are supported, and the drive or driven shaft are positioned and held in the relative position thereof by the mounting structure in such a manner that the individual components can execute the movements thereof as intended in an axial piston machine. The components which are fixed in position by the mounting structure are preferably inserted together with the mounting structure into a housing, in particular into a gearing housing, and are furthermore preferably fastened thereto via the closing plate.

The mounting structure remains preferably on the axial piston machine in the inserted state and is preferably not removed after installation of the axial piston machine in the housing. However, in a further preferred embodiment, the removal or the partial removal, for example only of one strut or of individual struts of the mounting structure, after insertion of a mounting structure into a housing is conceivable and is therefore covered by the inventive concept.

The use of a mounting structure according to the invention not only saves time, but also costs, in particular since a separate housing does not have to be provided for an axial piston machine. The mounting structure here is preferably configured in such a manner that it remains fixedly connected to the axial piston machine in a gearing both in the fitted and in the removed state of the axial piston machine. In the event of a possible repair or maintenance situation, the axial piston machine can therefore be removed as an assembly from a hydromechanical functional unit. The removal of individual parts necessary in this case in the prior art is dispensed with, which, in turn, saves costs and makes the axial piston machine more easily accessible in the removed state for maintenance.

The effect achieved by the mounting structure according to the invention is that an axial piston machine can be provided without a housing. When the housing-free axial piston machine is installed in a gearing housing or axle housing, the drive shaft and driven shaft can be connected directly to a shaft or to a gearwheel of the gearing or of the axle, wherein the gearing housing or axle housing at the same time forms the housing of the axial piston machine. Not only is the production of a second housing therefore omitted, but so too is the required coordination of the interfaces for two separate housings.

With the mounting structure according to the invention, a housing-free axial piston machine can be provided in a functional unit consisting of gearing and axial piston machine, the space requirement of which in a working machine, for example a tractor, a construction machine or in other vehicles, is minimal. According to the invention, space does not have to be provided for the otherwise customary housing of the axial piston machine. A corresponding receptacle/fastening to the gearing housing is to be provided merely for the fixing and supporting of the closing plate, but said receptacle/fastening can be designed more simply than if a housing of a hydraulic axial piston machine has to be flanged onto a gearing housing. In particular, screw connections, which are arranged deep in the gearing housing, of conventional housing for axial piston machines with gearing housings or clutch housing are avoided. By this means, a substantially simpler construction and access to a functional unit having a hydraulic axial piston machine and gearing connected thereto is possible.

The avoiding according to the invention of a housing for an axial piston machine not only saves on space and costs for an additional housing for, for example, a gearing in a working machine, but also on weight, which is of advantage in particular in the case of vehicles. By means of the provision of a housing-free axial piston machine, the latter can be integrated more flexibly into the overall concept of a working machine or of a vehicle. The space requirement necessary for the axial piston machine is reduced here to a minimum. Owing to the integral design of a functional unit having an axial piston machine and a gearing, the forces occurring during the operation of the functional unit can be better absorbed, since the unit is of more compact design and therefore the force paths are shorter. As a result, a better introduction of force or removal of force by the axial piston machine to or from the gearing or to or from the axle is achieved. A drive train designed in such a manner is therefore stiffer and more robust per se. The response performance of the functional unit is also improved by comparison to conventional two-housing solutions because of the short force paths.

In a preferred embodiment, the receptacle of the mounting structure for the drive or driven shaft forms a holder for a plain or rolling bearing, with which holder the axial piston machine can be mounted rotatably in the (gearing) housing. In a further preferred refinement, the receptacle can furthermore integrally form a bearing shell for a plane or rolling bearing, and therefore, when an axial piston machine with an mounting structure is fitted, the second bearing shell can be formed, for example, by the housing. In the case of such an example of the integration of the axial piston machine in a gearing housing or axle housing, only the bearing cage with the rolling bodies therefore still has to be introduced between the two bearing shells before the housing-free axial piston machine is fastened in the housing.

The receptacle arranged on the mounting structure according to the invention and intended for the positioning of the drive or driven shaft of the axial piston machine is connected preferably by at least one strut or by a basket-or net-like connecting structure to a closing plate of the axial piston machine, in which, for example, the hydraulic fluid feed line and discharge line for operation of the axial piston machine is also formed, and/or on which a (servo) displacement unit can be arranged. In the case of a bent axis axial piston machine, a closing plate of this type supports a setting element which is swiveled together with the cylinder block unit in order to adjust the delivery volume. In axial piston machines of swash plate design, the receptacle which is arranged on the mounting structure and is intended for the drive or driven shaft can be connected to the counter bearing/support of the swash plate in such a manner that the swash plate can be swiveled in order to adjust the delivery volume of the axial piston machine. Analogously, the receptacle which is arranged on the mounting structure and is intended for the drive or driven shaft can form, for example, the counterbearing/support of a non-adjustable swash plate of a hydraulic constant machine.

Irrespective of the type of construction of the axial piston machine, the receptacle for the drive or driven shaft of the hydraulic axial piston machine is formed on the mounting structure connected to a closing plate which, for example, supports the pressures prevailing in the cylinder bores during operation of the axial piston machine. When a housing-free axial piston machine is installed, said closing plate is fixedly connected to the (gearing) housing, and therefore the relative position of the cylinder block unit with the displacing piston accommodated therein with respect to the drive or driven shaft is maintained, which position is necessary for the operation of the axial piston machine. Before the axial piston machine is inserted into a housing and connected thereto, preferably via the closing plate, the struts or the basket/the net, which, together with the receptacle for the drive or driven shaft, form the mounting structure, take on the task of holding the axial piston machine in a functionally ready position. "Functionally ready" here means, when the axial piston machine is not fitted into a housing, that all of the components of the axial piston machine are positioned in a manner as though a housing in which the axial piston machine can be operated were present. However, the basket-like connecting structure of the mounting structure, in particular the struts or a net, is generally not designed to be able to absorb high compressive forces which occur, for example, during regular operation of an axial piston machine. Optionally, however, the at least one strut is of solid design such that a "dry run" or a functional testing of the axial piston machine outside a housing is possible.

The connection of the at least one strut to a closing plate, optionally with an displacement unit arranged thereon, can take place here by means of generally customary types of fastening, i.e. by means of screwing, riveting, welding, adhesive bonding, flanging, nailing, etc. An embodiment of at least one of the struts as a textile tension tie is also conceivable, wherein said tension tie could, for example, even be fastened with knots to the closing plate so that, after or during the mounting of the axial piston machine in a housing, the tension tie can easily be removed. The same types of connection are also conceivable for the connection of the at least one strut, the basket, or the net to the closing plate. The struts, the net or the basket of the mounting structure according to the invention can generally be of stiff, flexurally weak or elastic design as long as the net or the basket or the at least one strut can be used to transmit tensile forces which hold the closing plate, the cylinder block unit with displacing pistons arranged therein and the drive or driven shaft in a functionally ready position relative to one another, and therefore as though the above-mentioned assemblies were accommodated by a housing. The connecting structure, i.e. the basket, the net or the at least one strut, is preferably formed from plastic, metal, textile or rubber. It is possible, for example, for each strut here to be manufactured from a different material as long as the interaction of the struts holds the closing plate, the cylinder block unit and the drive or driven shaft in the position provided for the installation of the axial piston machine. A basket structure or net structure which is reinforced with struts or ties and is composed of identical or different materials is also covered by the inventive concept, as is the three-dimensional freedom of design of the connecting structure, for example in the form of a truncated cone, a paraboloid or simply in the form of a cylinder.

The receptacle which is formed on the mounting structure according to the invention and is intended for the drive or driven shaft of the axial piston machine can likewise be produced from plastic, metal, textile or rubber or from a pair of said materials, depending on the demands imposed on the receptacle. If the receptacle is intended at the same time to form a bearing shell for the mounting of the drive or driven shaft in the housing, said receptacle is preferably formed from metal so that the corresponding loads can be absorbed. If only a holding function is to be realized by the receptacle, a design made of plastic, textile or rubber is readily conceivable.

The main function of the mounting structure according to the invention for an axial piston machine without a housing consists in holding the closing plate, the cylinder block unit with the displacing pistons accommodated therein and the drive or driven shaft in a position in which the housing-free axial piston machine is functionally ready. The mounting structure according to the invention is intended to ensure this both in the fitted state of the axial piston machine in a gearing housing, i.e. when the closing plate is fixedly connected to a gearing housing and the drive or driven shaft is accommodated rotatably in the housing, and in the non-fitted state of the axial piston machine when, for example, a load-free test run or test run to be carried out at low loads or functional testing is intended to take place. By means of the mounting structure according to the invention, the axial piston machine is held in a stable manner per se as though said axial piston machine were accommodated in a housing. By means of the arrangement and/or positioning of the main assemblies of an axial piston machine—the closing plate, the cylinder block unit with the displacing pistons accommodated therein and the drive or driven shaft—by the mounting structure according to the invention, a housing-free axial piston machine can be inserted as one assembly (together) into a housing which is preferably a gearing housing with a gearing arranged therein, and therefore the axial piston machine can interact with the gearing, for example an axle gearing, as a hydromechanical functional unit.

After the housing-free axial piston machine is fitted into the gearing housing, the mounting structure can remain on the axial piston machine, since the basket-like design of the mounting structure is configured in such a manner that the components which are essential for the functioning of an axial piston machine are accommodated by the mounting structure in such a manner that the axial piston machine can be operated within the mounting structure in the—optionally adjustable—"dry run". That is to say, at least the cylinder block unit can rotate with the displacing pistons accommodated therein, wherein the pistons can move in a translatory manner and the drive or driven shaft in a rotatory manner. Depending on the configuration of the mounting structure, in particular the at least one strut of the basket and the receptacle for the drive or driven shaft, the axial piston machine can be operated outside a housing in a test run with loads of differing size. Theoretically, for an actual test run with actual loads, a suitably robust mounting structure for this purpose is also conceivable. Although operation of an axial piston machine entirely without housings is conceivable, this can be realized only in exceptional cases in practice because of leakages and the risk of soiling of the moving components of an axial piston machine. In such a case, given a suitably robustly configured mounting structure, it is possible to provide a protective housing which can be of correspondingly lightweight design, since it is intended only to receive leakage fluid and to protect the axial piston machine from soiling.

The mounting structure can preferably serve at the same time as an arrangement structure for add-on parts, such as switches, sensors, detectors, transmitters, receivers, electric lines, lubricant lines, adjusting or coordinating screws, etc., which are arranged in particular on the at least one strut or the basket of the connecting structure or on the receptacle for the drive or driven shaft. Furthermore preferably here, at least one of the struts themselves can be designed as a lubricant line or electric line which passes on lubricant or current to one of the add-on parts or to the plain or rolling bearing or the plain or rolling bearings for the mounting of the drive or driven shaft. In this case, the receptacle for the drive or driven shaft can also have an integrated lubricant line. Furthermore, the at least one strut or the basket- or net-like structure can also be designed in such a manner that a mechanical, pneumatic, hydraulic, electric or optionally optical signal line is also made possible via the mounting structure in order, for example, to suitably activate a clutch or other functional units.

Preferred exemplary embodiments which serve to explain the mounting structure according to the invention, the axial piston machine with the mounting structure according to the invention and the hydromechanical functional unit according to the invention are described below with reference to figures, in which:

DETAILED DESCRIPTION OF THE PREFERRED EMBODIMENTS

Figure 1:
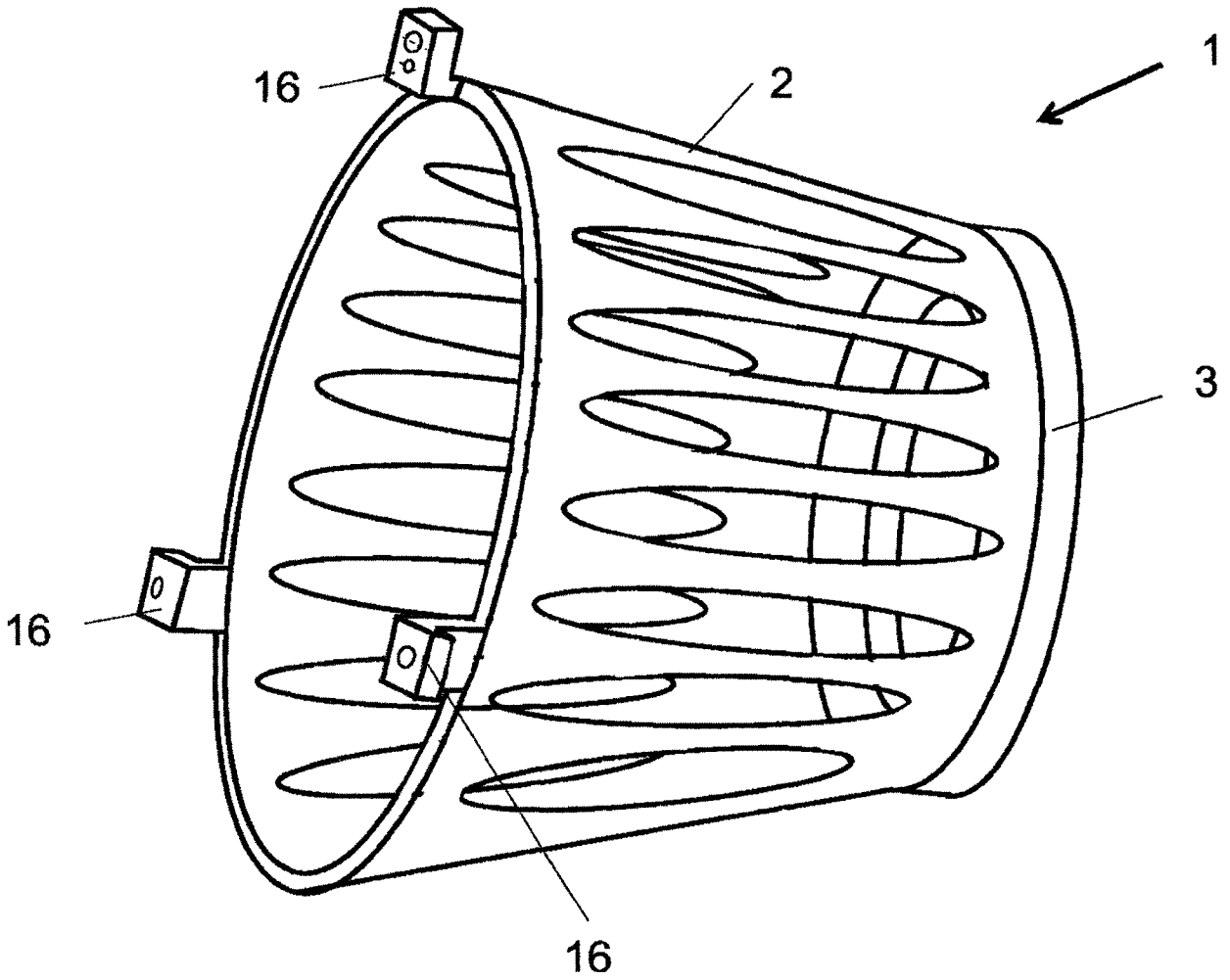
FIG. 1 shows schematically a perspective view of a first embodiment of the mounting structure according to the invention for an axial piston machine.

FIG. 1 illustrates a mounting structure 1 according to the invention for an axial piston machine without a housing, the figure showing an annular receptacle 3 for the drive or driven shaft of the axial piston machine and a basket-like connecting structure 2 which, similar to a perforated casing, surrounds the moving parts of an axial piston machine. The mounting structure 1 which is shown in FIG. 1 and is in the form of a basket with an open face, which constitutes a receptacle 3 for the drive or driven shaft of an axial piston machine, is not provided here for absorbing the supporting forces occurring during the working mode of an axial piston machine, as is provided in conventional axial piston machines with a housing. The receptacle 3 for the drive or driven shaft of an axial piston machine forms, together with the connecting structure 2, the basket-like mounting structure 1 according to the invention. The mounting structure 1 can be connected via extensions 16 to a closing plate of an axial piston machine, and therefore the receptacle 3 is fixed in the relative position thereof with respect to the closing plate of the axial piston machine via the connecting structure 2, as a result of which a housing-free axial piston machine is held together by means of the mounting structure 1 according to the invention in such a manner, and the components thereof are held in position in such a manner, as though the axial piston machine were accommodated in a housing.

Figure 2:
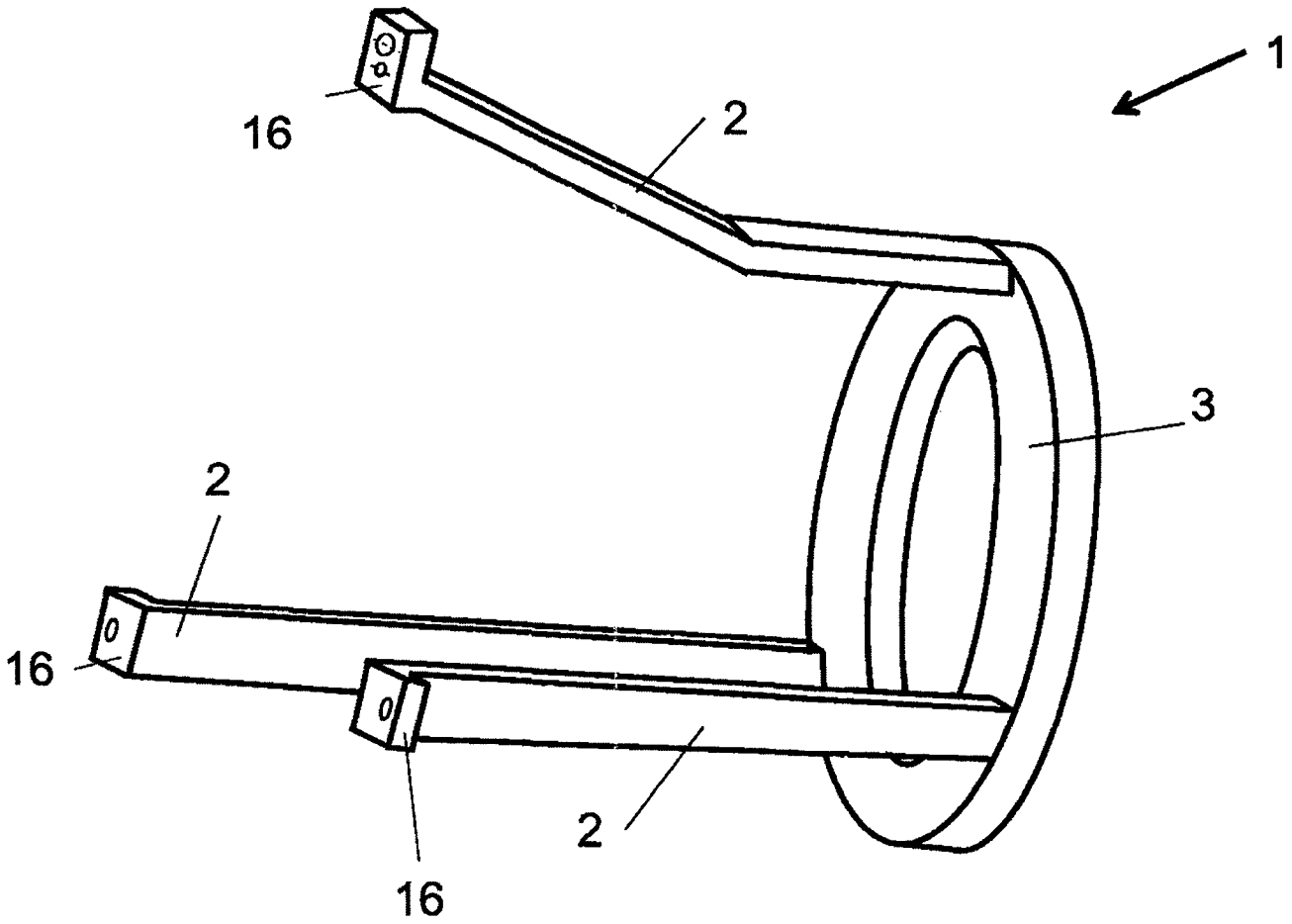
FIG. 2 shows schematically a perspective view of a second embodiment of the mounting structure according to the invention for an axial piston machine.

FIG. 2 shows a second exemplary embodiment of a mounting structure 1 according to the invention with a connecting structure 2, which is designed in the form of three struts, between a receptacle 3 for a drive or driven shaft of an axial piston machine and extensions 16 for fastening the mounting structure 1 to a closing plate for an axial piston machine. The mounting structure 1 which is constructed in the manner of a tripod is of integral design here, but this is only by way of example. It is customary in the art for each of the struts 2 per se and also the receptacle 3 to be able to be designed as individual parts which then, suitably connected to one another, form the mounting structure 1 according to the invention. The number of struts 2 shown in FIG. 2 is likewise only by way of example and is selected only for the purposes of explanation. The receptacle 3 for the drive or driven shaft 7, which, of course, can also be of polygonal design, can also be connected, for example, by only one or two struts 2 or a multiplicity of struts 2 to a closing plate 11 of an axial piston machine 100 (cf. FIGS. 3-6). In a documented manner, the individual struts 2 can be manufactured from the same material or from different materials, in the same manner as the receptacle 3 does not have to be produced from the same material as the struts 2, but rather, according to its function, from the most suitable material for this. This also expediently applies to the basket-like embodiment of the mounting structure 1 that is shown in FIG. 1. If the receptacle 3 for the drive or driven shaft of an axial piston machine 100 is intended at the same time to form a bearing shell for the rotatable mounting of the drive or driven shaft in a gearing housing, the receptacle 3 is preferably formed from metal.

Figure 3:
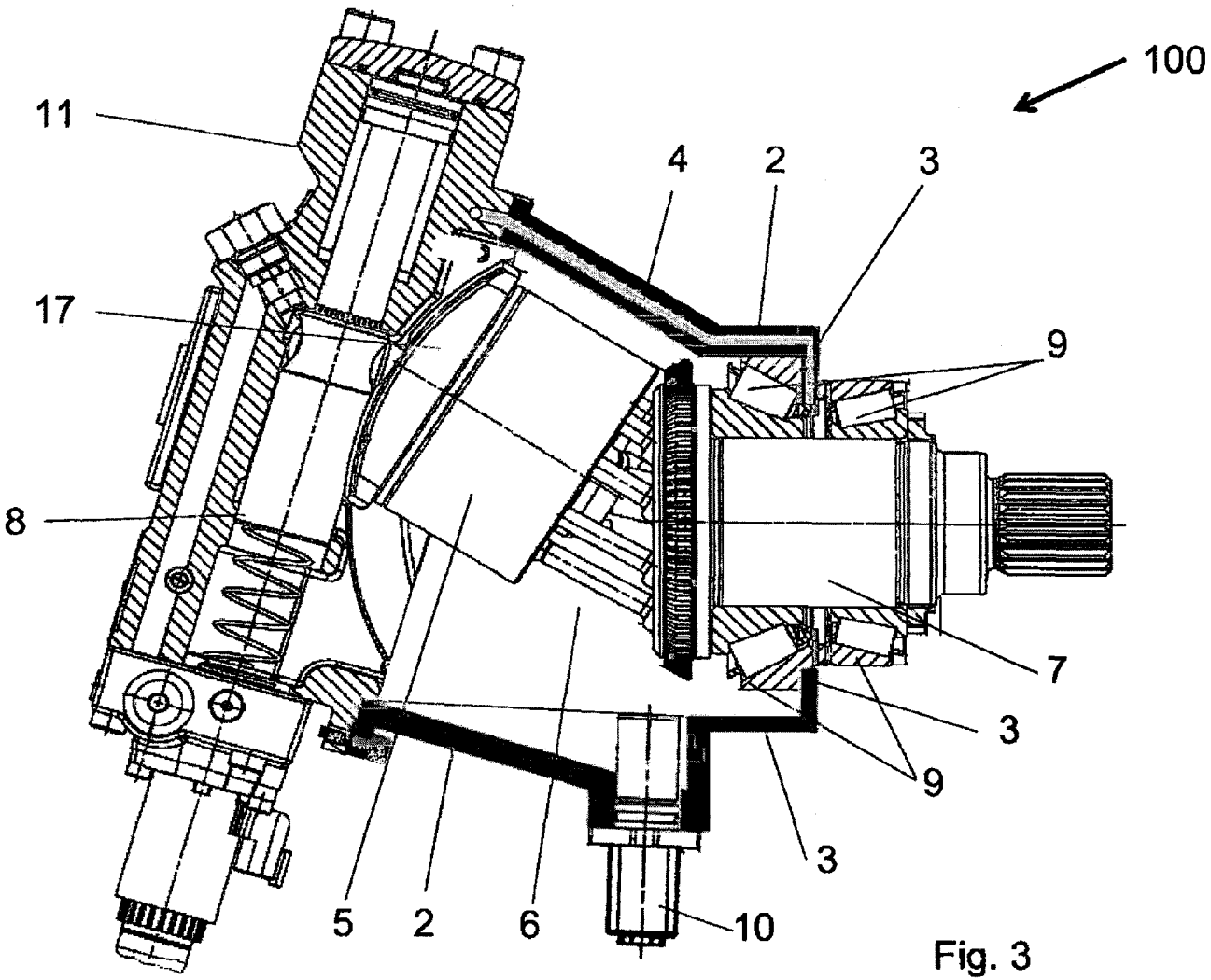
FIG. 3 shows a sectional view of an axial piston machine of bent axis design with the mounting structure according to the invention.

FIG. 3 shows a housing-free axial piston machine 100 which is held in a functionally ready position by the mounting structure 1, in precisely the same manner as would take place in a housing. FIG. 3 illustrates an axial piston machine 100 of bent axis type of construction purely by way of example. As is customary in the art, and therefore covered by the inventive concept, the mounting structure 1 can also be used in an analogous manner for an axial piston machine of swash plate or swivel-plate type of construction or for a hydraulic constant machine (cf. FIG. 6).

Figure 4:
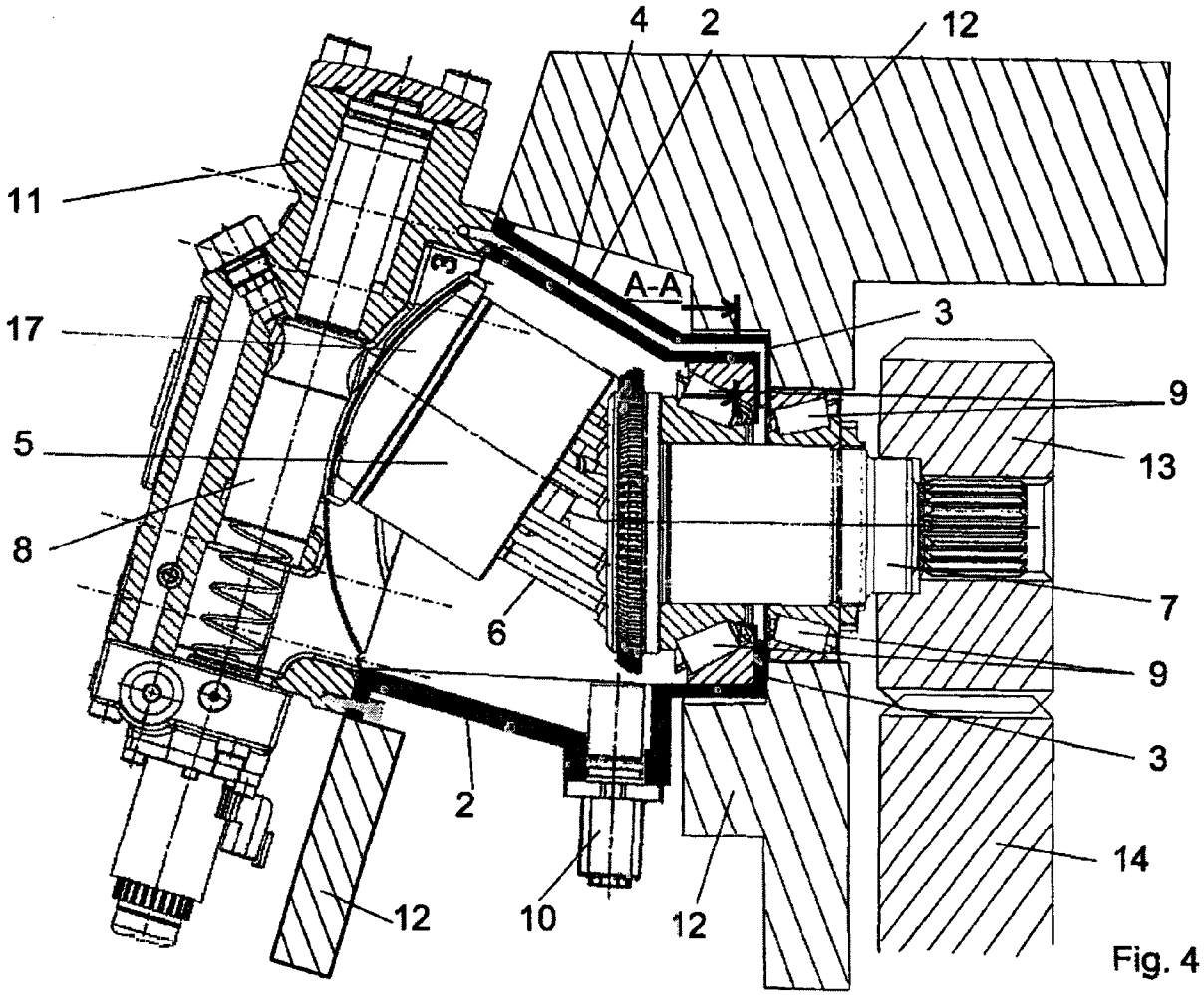
FIG. 4 shows a sectional view of an axial piston machine of bent axis design with a mounting structure according to the invention which is accommodated together with a gearing in a gearing housing.
Figure 5:
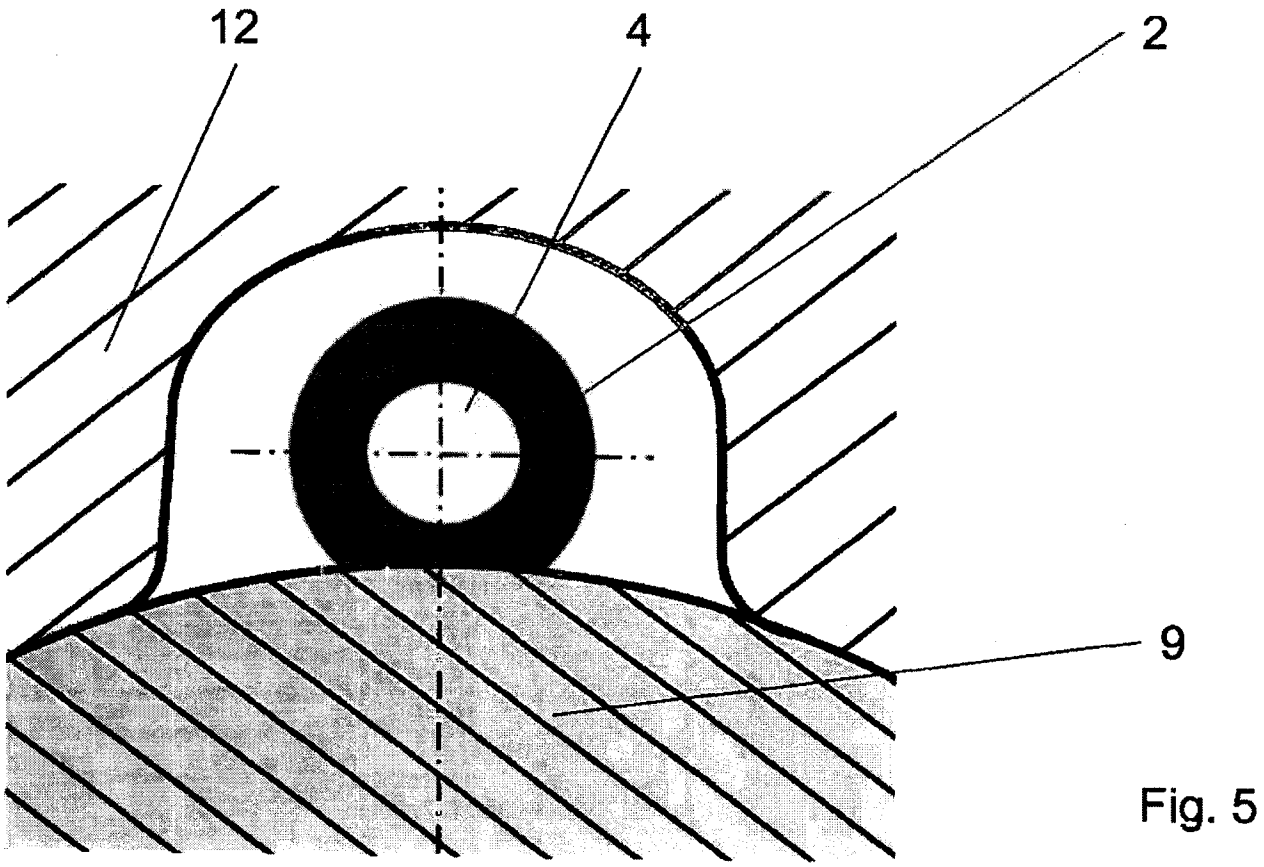
FIG. 5 shows a view of a detail from a clearance in the housing for a mounting structure according to the invention accommodating the mounting of the drive or driven shaft of an axial piston machine.

The bent axis axial piston machine 100 illustrated in FIG. 3 is held by the mounting structure 1 in a position capable of being fitted and also capable of functioning, wherein, in FIG. 3, an displacement unit 8 integrated in a closing plate 11 holds the cylinder block unit 5 in a swiveled-out position. From the illustration in FIG. 3, it is seen that the cylinder block unit with the displacing pistons 6 arranged therein is swiveled by the displacement unit 8 in the swiveling angles provided for the axial piston machine 100, and the mounting structure 1 does not restrict the ability of swiveling, i.e. the adjustability of the delivery volume of the axial piston machine 100. The axial piston machine 100 accommodated in this manner by the mounting structure 1 can be inserted as an assembly into a housing, wherein the roller bearings 9 arranged on the drive or driven shaft 7 have to be fixed in a housing. The mounting structure 1 can remain connected here to the axial piston machine 100 if, for example, corresponding clearances are provided in the housing. A corresponding view of a detail of such a clearance is illustrated in FIG. 4.

It is furthermore apparent from FIG. 3 that the struts 2 for holding the receptacle 3 of the drive or driven shaft 7 can serve at the same time as a holder for add-on parts 10, here for a rotational speed sensor. Furthermore, an integrated lubricant line 4 which can feed lubricant through the receptacle 3 to the rolling bearing 9 is illustrated schematically in the upper strut 2. However, the cavity formed in the upper strut 2 of the mounting structure 1 can serve as a cable duct or as a receptacle for a signal line.

FIG. 3 furthermore shows by way of example the lubricant supply between the two rolling bearings 9 which are positioned obliquely with respect to the axis of rotation of the drive or the driven shaft 7. However, any other supply of lubricant to the rolling bearing/the rolling bearings that is customary in the art is covered by the inventive concept precisely as is the mounting of the drive or driven shaft in a housing by just one roller bearing 9. Furthermore, the inventive concept also covers arranging the displacement unit 8 outside the closing plate such that the pressures occurring in the cylinder bores of the cylinder block unit do not load the displacement unit. Such a closing plate without a displacement unit can be used, for example, in hydraulic constant motors in which the delivery or displacement volume cannot be adjusted.

Figure 6:
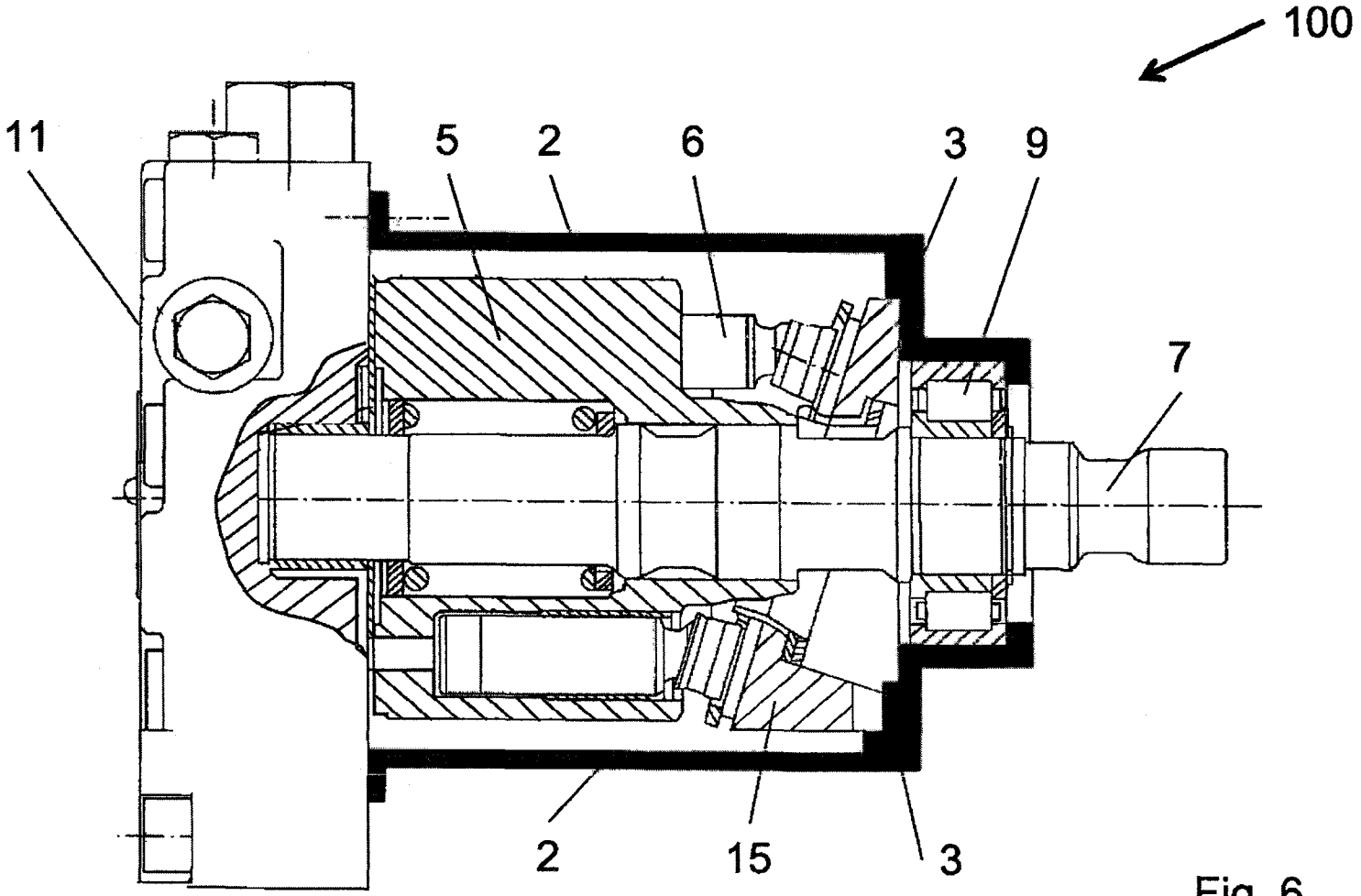
FIG. 6 shows a sectional view of an axial piston machine of swash plate design with the mounting structure according to the invention.

In an exemplary embodiment, which is shown in FIG. 6, in an axial piston machine of swash plate type of construction, the receptacle 3 of the mounting structure 1 can serve as a supporting pressure plate for the swash plate which, for as long as the axial piston machine 100 is not yet inserted into a housing, can absorb pressure only to a limited extent. Other variations of axial piston machines 100 of constant or displacement machine design that are not described here but are customary in the art, for example of bent axis, swash plate, swiveling-axle or swiveling-plate design, are usable with the mounting structure 1 according to the invention and are therefore covered by the inventive concept. Irrespective of the type of construction of the axial piston machine, the closing plate 11 is located on that side of the axial piston machine 100 which is opposite the drive or driven shaft 7 and on which the displacement unit 8 is customarily also located, wherein the actual displacement device, in particular the swash plate 15, can be arranged on that side of the cylinder block unit 5 which is opposite the displacement unit 8.

FIG. 4 schematically illustrates, with reference to a further exemplary embodiment, the fitting of the axial piston machine 100 from FIG. 3 in a gearing housing 12. The drive or driven shaft 7 of the axial piston machine 100 is connected here to a gearwheel 13 which meshes with a further gearwheel 14. The rolling bearing 9 facing the cylinder block unit 5 is supported here outside the regions of the connecting structure, here the struts 2, by the housing 12 as is the rolling bearing 9 facing the gearwheel 13. A corresponding clearance for the struts 2 in the housing 12 can be gathered from the view of the detail in FIG. 4 and is indicated in FIG. 4 by the intersecting line or reference line A-A.

As is clear from FIGS. 1 to 6, a housing for the use of an axial piston machine 100 in a functional unit with a gearing can be saved on by the use of a mounting structure 1 according to the invention. The axial piston machine 100 can be fitted and removed here without a housing, but with the mounting structure 1 according to the invention, as an assembly of the functional unit. The mounting structure according to the invention holds the closure plate 11, the cylinder block unit 5 and the drive or driven shaft 7 in a position in which the axial piston machine 100 can be operated theoretically or can carry out a test run or dry run. The adjustability of the delivery volume of the axial piston machine 100 is preferably maintained when the mounting structure 1 according to the invention is used.

What is claimed:

1. Mounting structure (1) for the housing-free installation of a hydraulic axial piston machine (100) of bent axis or swash plate design, with a drive or driven shaft (7) and with a closing. plate (11) on which a cylinder block unit (5) with displaces pistons (6) arranged therein is supported, wherein the mounting structure (1) is designed in the manner of a basket or with struts and has a receptacle (3) for the drive shaft or driven shaft (7) and a connecting structure (2) which is connectable at a first end to the receptacle (3) and at a second end to the closing plate (11) in such a manner that the closing plate (11), the cylinder block unit (5) and the drive or driven shaft (7) are held—analogously as in a housing—in a functionally ready position, characterized in that the second end of the connecting structure (2), which end is to be connected to the closing plate (11), is arranged on that side of the axial piston machine (100) which is opposite the drive or driven shaft (7), and in that the mounting structure (1) is not provided for absorbing the supporting forces occurring during the working mode of the axial piston machine (100) wherein the struts arc screwable, rivotable, adhesively bondable, weldable, solderable or fastenable by knots to the closing plate (11), or are connectable thereto by flanging and/or nailing.

2. Mounting structure (1) according to claim 1, in which a roller bearing which is arranged on the drive or driven shaft (7) of an axial piston machine (100) is held by the receptacle (3).

3. Mounting structure according to claim 1, in which the receptacle (3) forms a bearing shell or a bearing receptacle for a roller bearing or plain bearing (9) and/or a pressure plate (15) for a swash plate.

4. Mounting structure (1) according to claim 3, in which the hearings shell or the support of the swash plate is formed integrally with the receptacle (3) of the mounting structure (1).

5. Mounting structure (1) according to claim 1, in which the mounting structure (1) is designed with a multiplicity of struts, and the receptacle (3) has a ring-like structure.

6. Mounting structure (1) for the housing-free installation of a hydraulic axial piston machine (100) of bent axis or swash plate design, with a drive or driven shaft (7) and with a closing plate (11) on which a cylinder block unit (5) with displacer pistons (6) arranged therein is supported, wherein the mounting structure (1) is designed in the manner of a basket or with struts and has a receptacle (3) for the drive shaft or driven shaft (7) and a connecting structure (2) which is connectable at a first end to the receptacle (3) and at a second end to the closing plate (11) in such a manner that the closing plate (11), the cylinder block unit (5) and the drive or driven shaft (7) are held—analogously as in a housing—in a functionally ready position, characterized in that the second end of the connecting structure (2), which end is to be connected to the closing plate(11), is arranged on that side of the axial piston machine (100) which is opposite the drive or driven shaft (7), and in that the mounting structure (1) is not provided for absorbing the supporting forces occurring during the working mode of the axial piston machine (100)wherein the struts are formed integrally together with the receptacle (3).

7. Mounting structure (1) according to claim 1, in which the struts are formed from plastic, metal, textile and/or rubber so as to be strong in tension, and the receptacle (3) is formed from plastic, metal, textile. and/or rubber.

8. Mounting structure (1) according to claim 1, in which add-on parts (10), in particular switches, sensors, detectors, transmitters, receivers, electric lines, lubricant lines, adjustment or coordinating screws, are arcangable on the struts.

9. Mounting structure (1) according to claim 1, in which a lubricant line (4), an electric line (4), a pneumatic line (4), a data line (4), preferably an optical data line (4), or a mechanical connecting line (4) is formed within at least one of the struts, wherein electric, optical, pneumatic or mechanical signals and/or data can be passed on by means of the receptacle (3).

10. Mounting structure (1) for the housing-free installation, of a hydraulic axial piston machine (100) of bent axis or swash plate design, with a drive or driven shaft (7) and with a closing plate (11) on which a cylinder block unit (5) with displacer pistons (6) arranged therein is supported, wherein the mounting structure(1) is designed in the manner of a basket or with struts and has a receptacle (3) for the drive shaft or driven shaft (7) and a connecting structure (2) which is connectable at a first end to the receptacle (3) and at a second end to the closing plate (11) in such a manner that the closing plate (11), the cylinder block unit (5) and the drive or driven shall (7) are held—analogously as in a housing—in a functionally ready position, characterized in that the second end of the connecting structure(2), which end is to be connected to the closing plate (11), is arranged on that side of the axial piston machine (100) which is opposite the drive or driven shaft (7), and in that the mounting structure (1) is not provided for absorbing the supporting forces occurring during the working mode of the axial piston machine (100);

a hydromechanical functional unit, in which an axial piston machine (100) is accommodated together with a mechanical gearing (13) in just one housing (12), wherein the drive shaft or driven shaft (7) of the axial piston machine (100) forms the drive or output of the gearing, and the axial piston machine (100) is connected removably to the housing (12); and after the axial piston machine (100) is installed in the housing (12), at least one of the struts can be removed.

* * * * *